United States Patent [19]

Drake

[11] 4,074,386

[45] Feb. 21, 1978

[54] ROOFING MOP

[76] Inventor: Bascom A. Drake, 7245 NW. 37th Ave., Miami, Fla. 33147

[21] Appl. No.: 773,433

[22] Filed: Mar. 1, 1977

[51] Int. Cl.[2] ..... A47L 13/20

[52] U.S. Cl. ..... 15/229 R

[58] Field of Search ..... 15/120 A, 147 R, 147 A, 15/147 B, 151, 153, 228, 229R, 229 A; 401/24, 288

[56] References Cited

U.S. PATENT DOCUMENTS

| | | | |
|---|---|---|---|
| 111,368 | 1/1871 | Moore | 15/151 |
| 1,613,790 | 1/1927 | Engendahl et al. | 401/288 |
| 2,008,044 | 7/1935 | Shaw | 401/288 |
| 2,264,882 | 12/1941 | King | 15/147 A |
| 2,295,914 | 9/1942 | Rasic | 15/229 R |
| 2,815,523 | 12/1957 | Fink | 15/229 A |
| 3,213,475 | 10/1965 | Shirley | 15/229 R |
| 3,216,039 | 11/1965 | McNelley, Sr. et al. | 15/229 A |

*Primary Examiner*—Daniel Blum

*Attorney, Agent, or Firm*—Ernest H. Schmidt

[57] ABSTRACT

A roofing mop having a tubular support member about which depending mop head strands are peripherally secured as doubled-over hanks of such strands, and within the upper end of which tubular support member a mop handle is removably secured, the lower end of the tubular support member having coaxially secured thereto a circular disc of comparatively large diameter operative to redirect the depending mop strands radially outwardly of the mop head to provide for the spreading of a wide area of roofing tar in a single mopping stroke.

1 Claim, 5 Drawing Figures

ROOFING MOP

The invention relates to roofing mops and is directed particularly to roofing mops of the type wherein the mop head strands are peripherally arranged about, and secured with respect to, a cylindrical or tubular mop head support member.

Various types of mops for spreading hot tar or asphalt in the construction of built-up roofs and the like have heretofore been devised. Such mops or mop heads commonly comprise a central, cylindrical support member, usually tubular, about which the mop strands, whether of cotton fiber or fibrous glass cord are peripherally secured in depending relation. The mop head strands of such mop heads, when dipped in the hot tar, have a tendency to contract and bunch together, thereby adversely affecting the sweep width of tar application that can be achieved in a single mopping stroke. Because the rapidity with which roof tarring must be done necessitates mopping in single, substantially non-overlapping strokes back and forth over the area to be coated, the tar spreading width of a mop is of great importance. It is, accordingly, the principal object of this invention to provide a novel and improved roofing mop which will spread a wider area of roofing tar with a single mopping stroke as compared with mops of comparable size or weight as heretofore constructed.

A more particular object of the invention is to provide a roofing mop head of the character described which overcomes the deficiencies of roofing mops heretofore devised by the provision of mechanism for radially spreading the peripheral mop strands outwardly of their tubular support structure so as to inhibit their tendency to bunch together, thereby achieving a greater width of spread in each mopping stroke.

Another object of the invention is to provide a roofing mop head of the character described including a tubular support member about which the mop strands are peripherally distributed and secured in depending relation, and a circular disc of substantially greater diameter than that of the support member attached to the end of said support member centrally of said dependent strands and adapted to radially deflect the strands and retain them in outwardly spread relation with respect to the longitudinal axis of the mop head.

Yet another object of my invention is to provide a mop head of the above nature which will be simple in construction, economical to manufacture and durable in use.

Other objects, features and advantages of my invention will be apparent from the following description when read with reference to the accompanying drawings. In the drawings, wherein like reference numerals denote corresponding parts throughout the several views.

Figure 1:
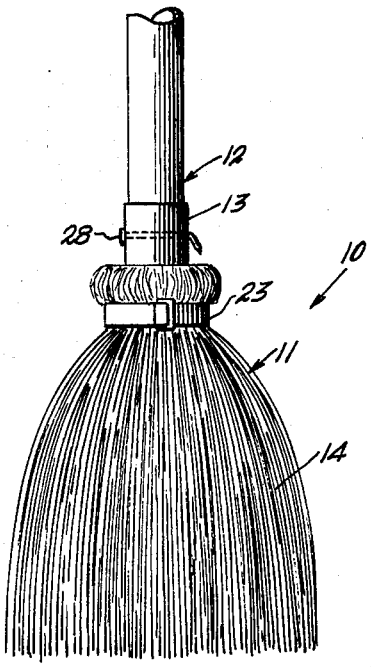
FIG. 1 illustrates a roofing mop embodying the invention, in elevation and with a portion of the mop handle broken away.

Referring now in detail to the drawings, reference numeral 10 designates, generally, a preferred form of roofing mop embodying my invention, the same comprising a mop head 11 and a tubular mop handle 12 removably attached thereto. The present invention is directed to improvements in the mop head 11 whereby a wider area of roofing tar can be spread with a single mopping stroke as compared with the same size or weight of mop head as heretofore contructed.

The mop head 11 comprises a tubular metal support member 13 in surrounding relation with respect to which the bunched mop head strands 14, whether of cotton twill, twisted strands of fiberglass or other mop head material, are securely attached in depending relation. Preferably, the mop head strands 14 will be applied as bunches of doubled-over hanks of the strands, indicated at 19 and 20, several hanks of which will be looped over a first wire loop 15 comprising a length of soft iron wire 16 passing through diametrically opposed openings 17, 18 provided in the tubular support member 13, and several hanks of which will be looped over the wire loop 21 formed by the opposing ends of the wire 16 when drawn together around the tubular support member 13 at the opposite side thereof. The plurality of hanks of the mop head strands will thus be more or less evenly distributed about the tubular metal support member 13 and fixed in place by twisting the ends of the soft iron wire 16 together as indicated at 22 in FIG. 3. As illustrated in FIGS. 1, 2, 3 and 4, the mop head strands 14 thus applied will be secured in place such as by use of a double-loop metal band 23 applied and secured by use of a banding tool, said band being applied in embracing relation just below the wire attachment loops. Since the use of such metal banding straps for peripheral securement or clamping is well-known and in and of itself forms no part of the present invention, further description thereof is not deemed to be necessary herein.

Figure 2:
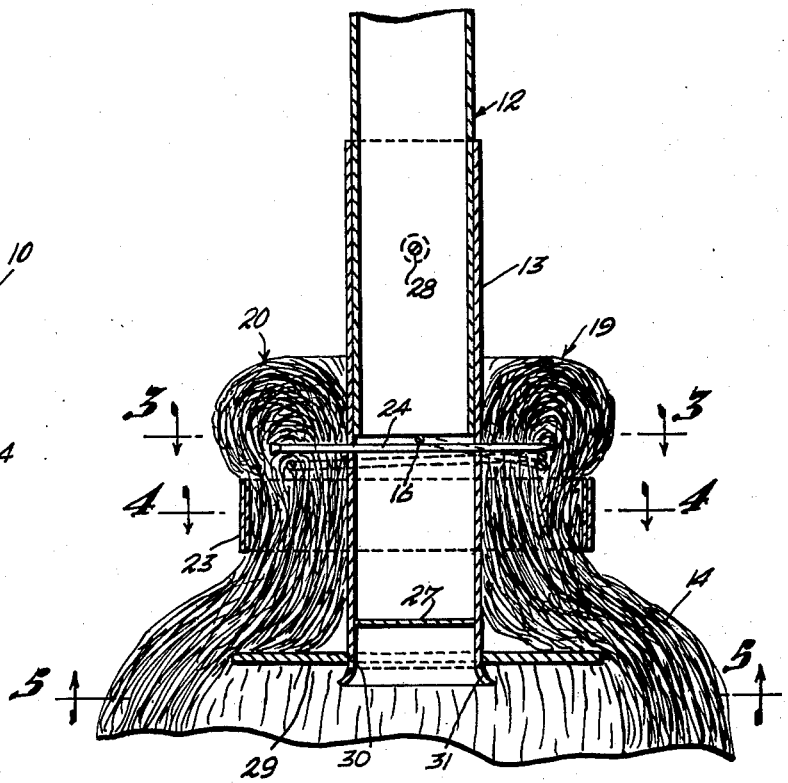
FIG. 2 is a vertical cross-sectional view of an upper portion of the mop head and handle assembly, on an enlarged scale to reveal constructional details.
Figure 3:
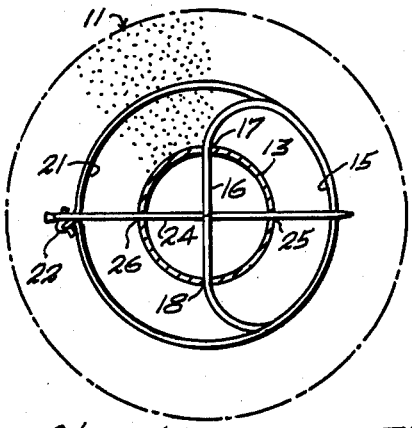
FIG. 3 is a transverse cross-sectional view taken on the plane indicated along the line 3—3 of FIG. 2 in the direction of the arrows.
Figure 4:
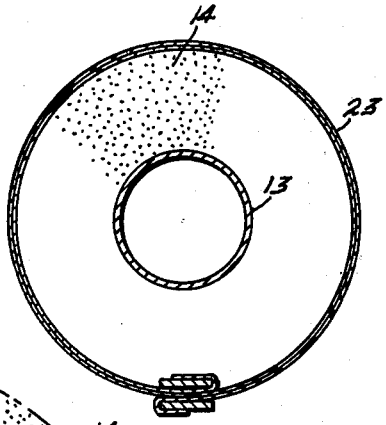
FIG. 4 is a transverse cross-sectional view taken on the plane indicated along the line 4—4 of FIG. 2 in the direction of the arrows.

As further illustrated in FIGS. 2 and 3, an ordinary nail 28 applied through diametrically opposed openings near the upper end of the tubular metal support member 13, can be used to secure the mop handle 12 in place with respect to the mop head 11 for use of the mop. During manufacture of the mop head a nail can be applied through these diametrically opposed openings for temporarily securing the tubular metal support member 13 to a cylindrical support fixture (not illustrated). Upon completion of the mop head assembly this support nail will be removed and applied through openings 25 and 26 in the tubular support member 13 cross-wise with respect to the diametrically opposed openings 17 and 18 to facilitate retention of the mop head strand hanks in their proper position during the final steps of assembly.

The lower end of the tubular metal support member 13 is closed by metal disc 27 press-fitted therein, said disc serving to prevent the flow of hot tar backwardly through said metal support member and thereby present a hazard to a workman using the mop for hot tarring.

Figure 5:
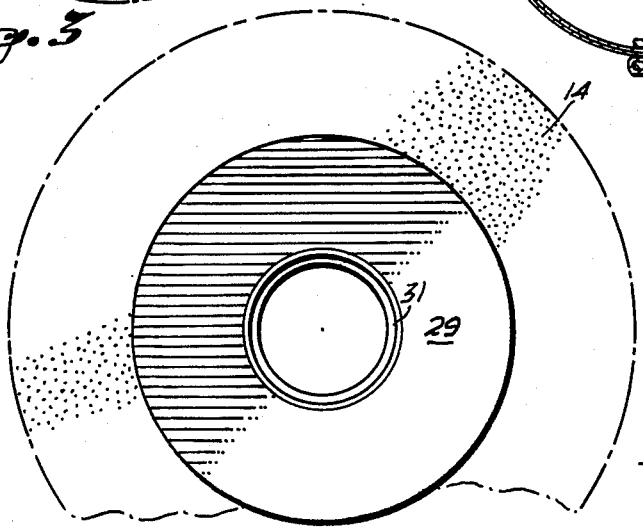
FIG. 5 is a transverse cross-sectional view taken along on the plane indicated along the line 5—5 of FIG. 2 in the direction of the arrows.

A salient feature of my invention resides in the provision of the internal spreader disc 29. As best illustrated in FIGS. 2 and 5, the spreader disc 29, which will preferably be stamped of sheet metal such as of aluminum, has a central opening 30 of such size as to fit snuggly over the lower end portion of the tubular metal support member 13, where it is securely retained in place by subsequently swaging or otherwise flaring a peripheral marginal end portion of said support member outwardly, as indicated at 31 in FIGS. 2 and 5. The diameter of said spreader disc being approximately three times the diameter of said tubular support member. As described above, the principal function of the spreader disc 29 is to spread the mop head strands 14 radially outwardly to increase the width of each stroke or sweep of tar application. As an additional feature and advantage, the spreader disc 29 also acts as an abutment member inhibiting inadvertent separation of the attached mop head strands over the lower end of the tubular support member 13. In this connection, it is to be understood that heretofore, without the improvement comprising the spreader disc 29, hard usage of a mop occasionally resulted in breakage of the wire binding and slippage of the mop head with its bands over the lower end of its tubular member.

While I have illustrated and described herein only one form in which my invention can conveniently be embodied in practice, it is to be understood that this embodiment is given by way of example and not in a limiting sense. My invention, in brief, comprises all the embodiments and modifications coming within the scope and spirit of the following claim.

What I claim as new and desire to secure by Letters Patent is:

1. A roofing mop comprising, in combination, a tubular metal support member, a plurality of flexible mop strands peripherally arranged about and secured to one end portion of said tubular support member in depending relation with respect thereto, a circular spreader disc coaxially secured to said one end of said tubular support member for constraining said mop strands radially outwardly of said support member, the diameter of said spreader disc being approximately three times the diameter of said tubular support member, said spreader disc being provided with a central circular opening of substantially the same diameter as the outer diameter of said tubular metal support member, an outer portion of said one end of said tubular support member being received through said central opening, the projecting terminal end portion of said one end of said tubular support member being outwardly flared to retain said spreader disc in secured position with respect to said support member, a metal disc press-fitted within said tubular metal support member to block the passage of hot tar backwardly therethrough, said plurality of flexible mop strands comprising a plurality of doubled-over bunches of said strands, an annular wire binding member secured to said tubular support member and over which said bunches of strands are looped, and clamping band means between said wire binding member and said support disc for clamping said plurality of strands peripherally about said tubular support member.

* * * * *